US005432320A

United States Patent [19]

Scheidler et al.

[11] Patent Number: 5,432,320

[45] Date of Patent: Jul. 11, 1995

[54] COOKING RANGE

[75] Inventors: Herwig Scheidler, Mainz; Martin Taplan, Ingelheim, both of Germany

[73] Assignee: Schott Glaswerke, Mainz, Germany

[21] Appl. No.: 138,424

[22] Filed: Oct. 20, 1993

[30] Foreign Application Priority Data

Oct. 20, 1992 [DE] Germany ..... 42 35 263.0

[51] Int. Cl.[6] ..... H05B 3/74

[52] U.S. Cl. ..... 219/464; 219/453

[58] Field of Search ..... 219/464, 453, 451, 506, 219/448; 200/600; 341/33; 307/116

[56] References Cited

U.S. PATENT DOCUMENTS

| | | | |
|---|---|---|---|
| 3,567,906 | 3/1971 | Hurko | 219/464 |
| 3,586,825 | 6/1971 | Hurley | 219/464 |
| 3,627,986 | 12/1971 | Anderson | 219/464 |
| 3,797,375 | 3/1974 | Cerola . | |
| 3,870,862 | 3/1975 | Doner | 219/464 |
| 3,947,652 | 3/1976 | Cobb | 219/464 |
| 4,511,781 | 4/1985 | Tucker et al. . | |
| 4,922,080 | 5/1990 | Kicherer | 219/451 |
| 4,948,949 | 8/1990 | Meisner | 219/448 |
| 5,001,329 | 3/1991 | Shimomura | 219/464 |
| 5,097,113 | 3/1992 | Aoyama | 219/448 |
| 5,149,944 | 9/1992 | Shimomura . | |

FOREIGN PATENT DOCUMENTS

| | | | |
|---|---|---|---|
| 0181141 | 5/1986 | European Pat. Off. . | |
| 2658591 | 8/1991 | France . | |
| 3003455 | 8/1980 | Germany . | |
| 3229406 | 3/1984 | Germany . | |
| 3641003 | 6/1988 | Germany . | |
| 2-290426 | 11/1990 | Japan | 219/451 |

*Primary Examiner*—Teresa J. Walberg

*Attorney, Agent, or Firm*—Millen, White, Zelano, & Branigan

[57] ABSTRACT

Cooking ranges with cooking surfaces in the form of a glass ceramic cover include functional elements such as operation and signal elements integrated into the cooking range. For improved utility and maintenance these functional elements are combined in at least one functional area forming a functional part (unit) arranged to be spatially separate from the cooking surface and independently replaceable.

15 Claims, 3 Drawing Sheets

COOKING RANGE

BACKGROUND OF THE INVENTION

The invention concerns a cooking range comprising at least one cooking surface in the form of a glass/glass ceramic cover, or the like, with cooking zones, wherein functional elements such as control and display elements combined in at least one functional area are integrated.

Such a cooking range, wherein the switches, signaling lamps, electronic or electromechanical components are arranged in the operating area of the cooking surface and which comprise a so-called "touch-control switch" as a functional element, is commercially available and known from French Patent FR 2 658 591 A1.

It has been found that these touch-control switches do not always operate without failure. The touch-control switches respond to the capacitive change occurring when a finger touches the glass ceramic upper surface. However, the sensor reacts more or less quickly, depending on the humidity of the finger with respect to the humidity of the glass ceramic upper surface. This unreliable response behavior ultimately results in customer dissatisfaction.

It could thus be considered to solve the problem by introducing borehole openings in the cooking surface and inserting passing respective switches or signaling lamps through said openings. In this case, however, the problem is that the sturdiness of the cooking surface is impaired and that, if damaged, the entire cooking surface becomes unusable. If these functional elements are to be additionally mounted damp-proof, it is necessary to glue them. However, if the functional element then breaks down, it can only be disengaged from the cooking surface with difficulty or not at all.

SUMMARY OF THE INVENTION

Starting from the cooking range described above, the problem of the invention is to accommodate functional elements in the working area of the cooking surface which display reliable response behavior and, in case of damage, facilitate simple and inexpensive replacement, while the evenness of the cooking surface is retained and the optical appearance of the entire cooking range may, if desired, be improved.

This problem is solved according to the invention in that the functional area is arranged as a unit which is spatially separated from the cooking surface and can be separately replaced.

The invention provides a solution to the problem by the simple method of physical separation of the cooking surface area from the functional area. Due to recesses required in the functional area, the functional area remains subject to threat of breakage, but these functional areas are easily replaceable. In case of damage, there is no need to replace the entire cooking surface, but only the damaged unit, i.e., the functional part. It is a further advantage of the cooking range according to the invention that the even flatness of the entire cooking range is retained and that the functional area may be provided in diverse designs and may therefore be used, on the basis of otherwise like cooking range design, to create the most varied models.

In addition to the functional area, preferably made of the same material as the cooking surface, it is also possible, in a further embodiment of the invention, to manufacture the functional area using a different material (e.g., enamel or steel plate). The scope for constructional and design variety is thereby increased considerably.

A number of options are available to the person skilled in the art for arranging the functional areas in the cooking range. To facilitate decentralized operation of the functional elements of the individual cooking zones, the functional areas are advantageously accommodated in the corner areas of the cooking range. It is also conceivable to provide an integrated section of the cooking range as the functional area. In this way, a central control area is obtained.

It is principally also possible to arrange the functional area as a component of polygonal sections with respect to sections of oval cooking ranges. The cooking range could be constructed in segments and the replaceable functional unit could therefore also be used as a special design feature.

The term "segmented construction" (modular construction) refers to the possibility of combining cooking ranges (different colors, patterns, heating element types) and functional elements of differential design in one product family. This provides the designer with a range of options for designing the entire cooking range, but at low manufacturing cost, since only a small number of different basic elements need to be manufactured.

In a further advantageous and practical embodiment of the invention, the borehole opening is flush-sealed to the surface of the functional element with a permanently elastic silicon adhesive acting like a membrane, so that the upper surface of the functional area retains its even flatness and this portion filled with silicon additionally provides flexibility for actuation of a short-stroke switch arranged underneath the same. In this case, the opening filled with silicon adhesive in the cooking surface acts like a membrane. Short path changes effected by finger impression are transmitted to the short-stroke switch below.

BRIEF DESCRIPTION OF THE DRAWINGS

Various other objects, features and attendant advantages of the present invention will be more fully appreciated as the same becomes better understood when considered in conjunction with the accompanying drawings, in which like reference characters designate the same or similar parts throughout the several views, and wherein.

DETAILED DESCRIPTION

Figure 1:
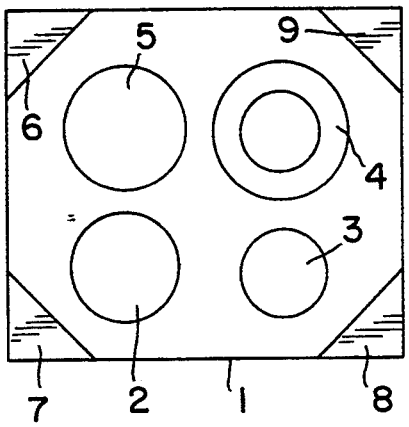
FIGS. 1–5 show top views of five different possibilities for integrating the functional areas in the cooking range.

FIG. 1 is a schematic plan view presentation of a cooking range 1 with a cooking surface in the form of a glass ceramic covering or first panel comprising four cooking zones 2, 3, 4 and 5. The number of cooking zones is merely exemplary; the cooking range may comprise any number of cooking zones. The material specified is also a preferred embodiment. Other materials suitable for forming into cooking surfaces may also be used, in particular materials consisting of brittle fracturing substances. The functional elements (not shown) such as switches, signal lamps, etc., are combined in function areas of second panels 6, 7, 8 and 9 constructed as functional parts (units), coplanar with and spatially separated from the cooking surface and arranged so as to be separately replaceable, as explained in detail in subsequent figures.

In the embodiment according to FIG. 1, the functional areas 6–9 are arranged in the corner area of cooking range 1. The functional area can thereby be confined to one corner or may occupy several corners, up to four corners, as shown, depending on the number of cooking zones to be integrated operationally.

Figure 2:
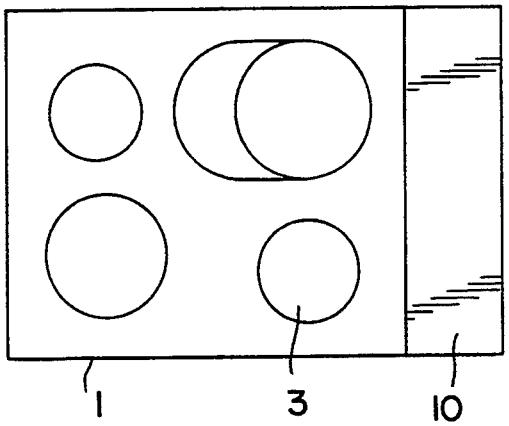

The cooking range according to FIG. 2 differs from that in FIG. 1 in that, in place of the corner arrangement, a complete section 10 of the cooking range is formed as the functional area. Such an arrangement permits the provision of functional area 10 as a centralized operating panel for the entire cooking range.

Figure 3:
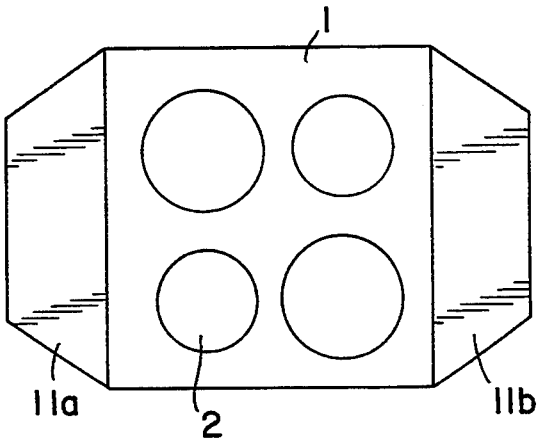
Figure 4:
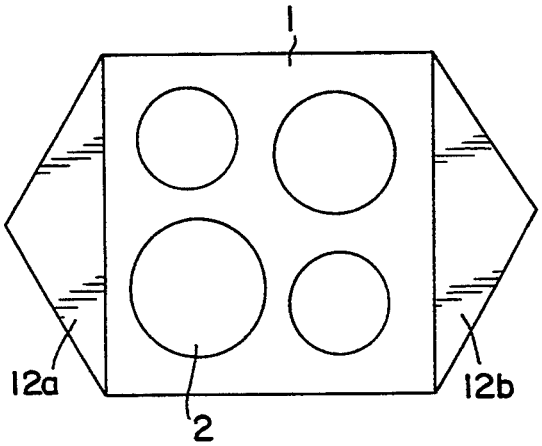
Figure 5:
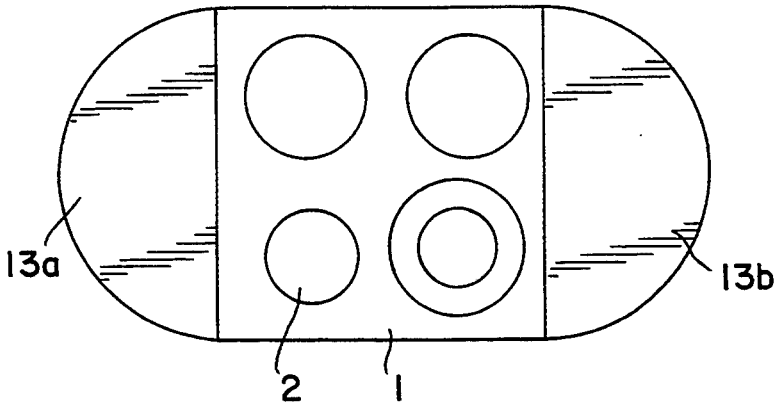

FIGS. 3–5 show cooking ranges, wherein the functional areas are respectively arranged on two sides of the cooking range in symmetrical alignment. In FIGS. 3 and 4, the functional areas are arranged to form part of respective polygons. In FIG. 3, the functional area is respectively of trapezoidal diameter and, in FIG. 4, of centrosymmetrical triangular diameter. FIG. 5 shows an embodiment wherein the functional area is arranged in the form of sections 13*a* and 13*b* of oval cooking ranges. In these embodiments according to FIGS. 3–5, it is conceivable to construct the cooking range in segments and to thus incorporate the replaceable functional unit as a special design element.

The concept "segmented construction" (modular construction) refers to the possibility of freely combining cooking ranges (different colors, patterns and heating elements) and functional elements of diverse design in a single product family. This provides the designer with a wide range of design options for the entire cooking range, but at low manufacturing cost, since only a small number of different basic elements need to be produced.

In addition to the arrangements of the functional areas according to FIGS. 1–5, a variety of other options are available to the person skilled in the art, which will be selected on the basis of considerations of utility, style, etc.

Figure 6:
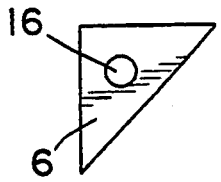
FIGS. 6–8 show top views of different options for arranging openings in the functional area covers.
Figure 7:
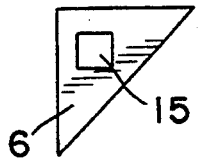
Figure 8:
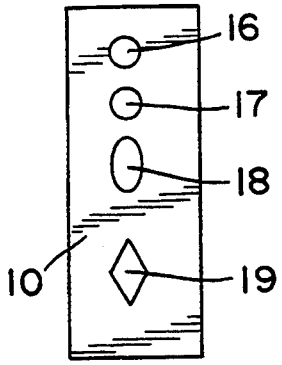

FIGS. 6–8 show different possibilities for arranging openings in the functional area covers to receive the functional elements, such as switches, signal lamps with respect to electronic or electromechanical parts. FIG. 6 thus shows as an exemplary embodiment the functional corner area 6 according to FIG. 1 with a round opening 14, whereas FIG. 7 shows the same corner area 6 with a square opening 15. FIG. 8 shows the functional area 10 according to FIG. 2 with two round openings 16, 17, an oval opening 18 and a rhombic opening 19.

Rectangular openings or openings with other diameters are also possible, which the person skilled in the art will select with reference to utility criteria.

In the functional areas 11, 12 and 13 of FIGS. 3–5 openings corresponding to those in FIGS. 6–8 are of course also provided. They are not shown to keep the drawings simple.

Figure 9:
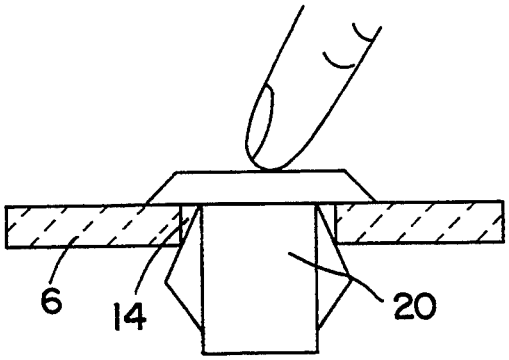
FIGS. 9–10 show side views of two possibilities for accommodating switches in the openings of the functional elements.
Figure 10:
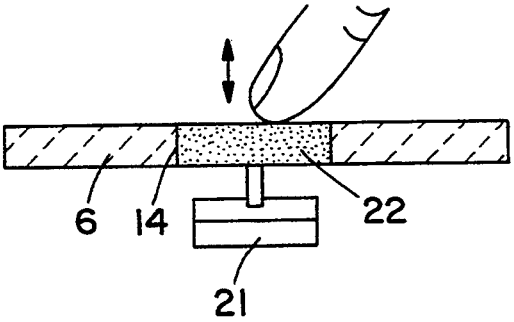

FIGS. 9 and 10 show two typical examples of the arrangement of a functional element in the form of a switch in the openings.

FIG. 9 shows in the functional area with respect to the opening 14 therein (corresponding to the presentation in FIG. 6), a switch 20 actuatable by hand which does not flush-close with the surface of the functional area.

As shown in FIG. 10, the opening 14 is, however, advantageously flush-sealed with the surface of the functional area 6 by means of silicon adhesive 22. This arrangement has the advantage that the upper surface is kept evenly flat and that the area filled with silicon is flexible so as to actuate a short-stroke switch arranged thereunder. In this case, the opening 14 filled with silicon adhesive 22 in functional area 6 acts like a membrane. Short path changes effected by finger impression can be transmitted to the short-stroke switch 21 below. A function of the cooking surface can thus be safely and reliably switched on or off, while the surface is tightly sealed and hygienic. The disadvantages of the capacitive touch-control switch are eliminated in this embodiment.

The arrangements according to FIGS. 9 and 10, of course, only represent selected examples. Other functional elements are appropriately mounted in functional areas of different design (e.g., those according to FIGS. 2–5) in the corresponding openings.

By reference to FIGS. 11–15, the possibilities for constructional arrangement of the functional areas in the cooking range are now described as follows.

Figure 11:
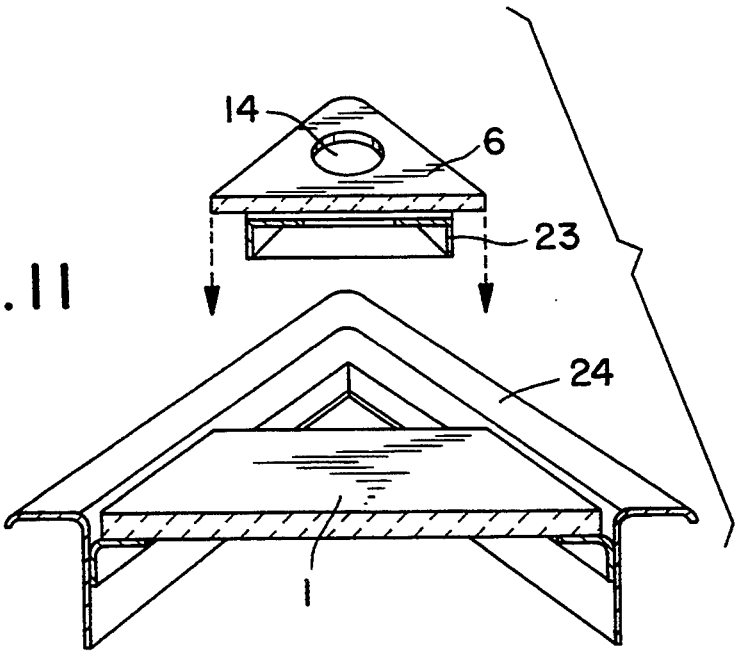
FIG. 11 shows an exploded perspective view of the arrangement of the functional element in the cooking range as an insert module.

FIG. 11 shows an embodiment on the basis of FIGS. 1 and 6 in exploded view. The cooking range 1 is completely enclosed by a frame 24, whereby at least one corner is recessed to receive the functional area 6 in the form of a replaceable insert module comprising opening 14 with respect to insert frame 23.

Figure 12:
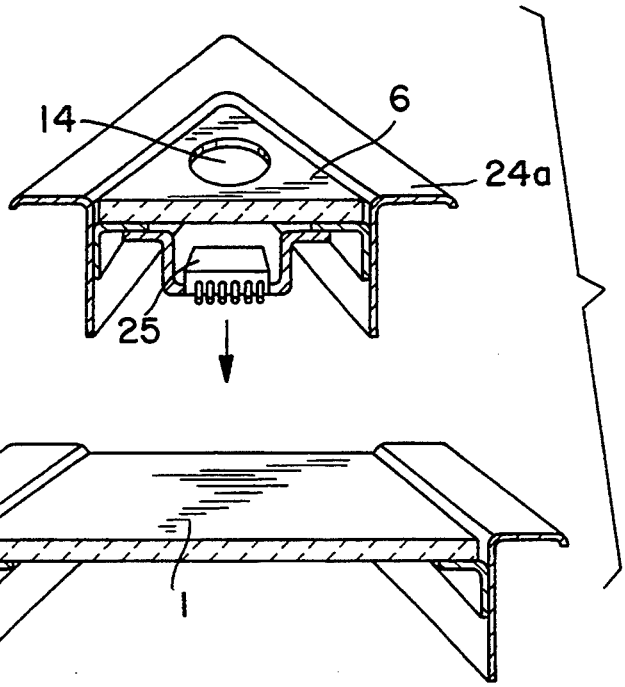
FIG. 12 shows a perspective view of the arrangement of the functional element as a complete extension module of a cooking range in exploded view.

In a development of the arrangement according to FIG. 11, the inverted L-shaped flange forming the frame 24 is removed in the corner areas of the cooking range according to FIG. 12 (exploded view) and integrated with the functional area 6 as position 24*a*, so that functional area 6 may form a complete extension module attached to a cooking range.

The same applies to the functional areas according to FIGS. 2–5.

The functional areas 6–9, 10, 11, 12 and 13 may therefore either be inserted in a frame enclosing the entire cooking range (FIG. 11) or they may be attached to a cooking range as a complete extension module (FIG. 12), whereby in both cases the switch member (not shown) may already be integrated in the opening 14 and connected to the cooking range during installation by means of corresponding plug connections.

Figure 13:
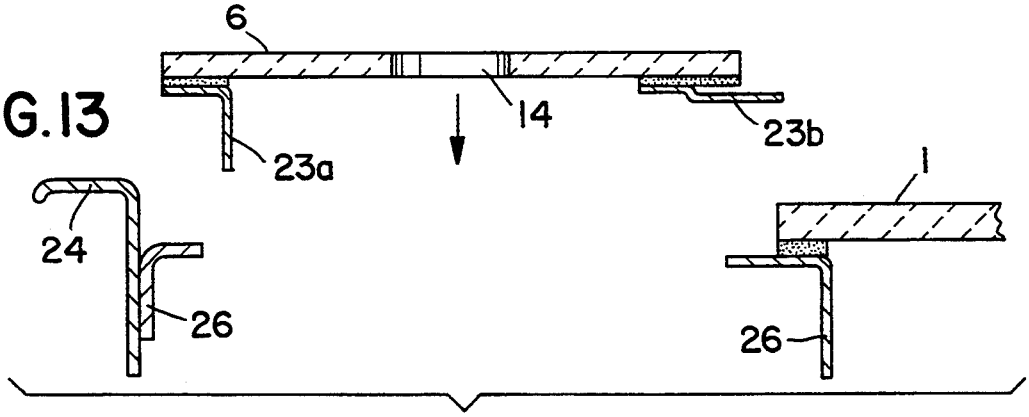
FIGS. 13–15 show front views of two options for mounting the replaceable insert module according to FIG. 11.
Figure 14:
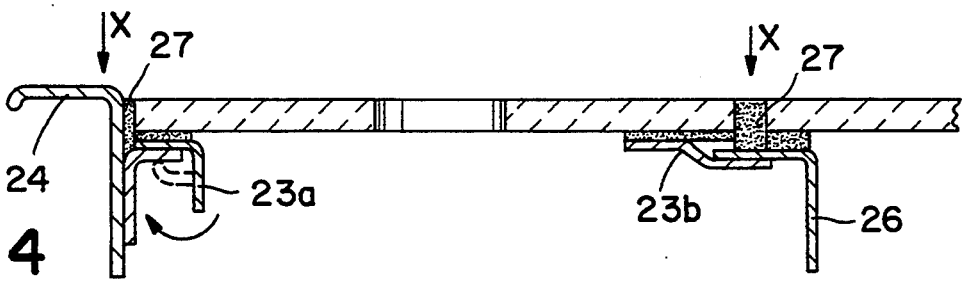

FIGS. 13 and 14 show in section an example of a constructional arrangement of an insert module according to FIG. 11, whereby FIG. 13 shows the condition before installation in exploded view and FIG. 14 shows the installed state. The section extends along the central perpendicular line into the cooking range corner (left edge in the Figures).

A small frame 23 (FIG. 11) is glued to the triangular functional unit 6 comprising opening 14. The small frame comprises bending flaps 23*a* arranged along the short sides of the triangle and a clamping ring 23*b* along its hypothenuse side. The cooking range 1 comprises an inverted L-shaped locking bar or bracket 26 glued thereto with a suitable adhesive, which extends into the free cooking range corner (viz. FIG. 11) along the enclosing frame 24 and is fixed thereto. The functional area or "functional corner" may be clamped into the L-shaped holding bar 26 of the cooking range by its clamping ring 23*b* and then be fully inserted in the inverted L-shaped flange forming the frame 24. The bending rings 23*a* on the short sides of the triangle can then be bent around and thus provide sufficient mechanical support to the functional corner. This assembled state is shown in FIG. 14.

Figure 15:
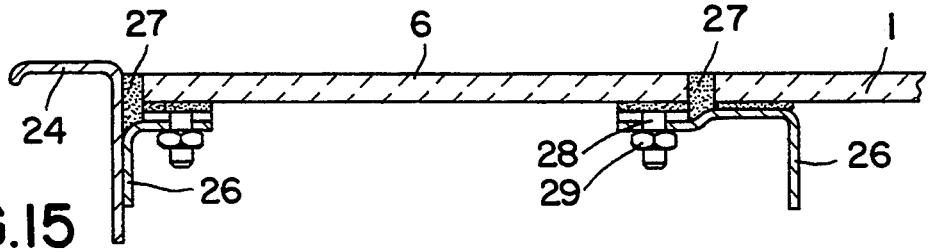

As is seen in FIGS. 14 and 15, opposed edges of the first and second panels 1 and 6, respectively, have gaps "X" therebetween which are filled with silicon adhesive 27.

In a final step the air gap "x" between the edge of cooking range 1 and enclosing inverted L-shaped frame 24 may be filled with silicon 27. The adhesion surfaces of the frame and, if necessary, of the front end of the cooking surface are first treated with a suitable separating agent (e.g., Molikote) to ensure that subsequent replacement (in case of damage) is easily possible. It is, however, also possible to insert a suitable gasket cord or an appropriately formed elastic profile ring.

If predetermined tolerances are observed, it is possible in a preferred embodiment to provide the functional corner with a prevulcanized adhesive edge, in particular a tip-stretched silicon rubber edge, before installation and to press the functional corner tightly into the cooking range corner. In this case, only the bending rings must be bent over after the functional corner is pressed in. This embodiment has the advantage that there is no need for subsequent filling of the air gap with a silicon adhesive and that extremely simple replacement is facilitated.

This constructional principle is, of course, not restricted to the triangular functional areas shown in the Figure, but applies equally to other, e.g., square, rectangular or semicircular functional areas.

In the patent publication DE 31 04 114 C2, a glass ceramic cooking surface with a prevulcanized silicon rubber edge is described which is replaceably inserted in a sealing frame. In the case of damage, however, the entire expensive cooking surface must be replaced. In the present invention, the functional area subject to breakage risk can be replaced independently of the cooking surface.

Instead of mounting the "functional corner" 6 by means of clamping ring 23*b* and bending ring 23*a*, as shown in FIG. 14, the functional corner may also be fastened to the cooking range frame by means of screw elements.

FIG. 15 shows such a construction in assembled state. Screw bolts 28 are glued along their length to functional area 6, whereby the inverted L-shaped holding bar or bracket 26 comprises bore holes for receiving the bolts which are screwable to the holding bar by means of nuts 29. The air gap between the cooking range and the enclosing frame is also sealed in this embodiment, e.g., with a silicon adhesive 27.

The mounting methods shown in FIGS. 13–15 are only examples for a whole range of mounting methods, which can principally be effected by means of bending rings, screwing, clips or clamping devices.

The entire disclosures of all applications, patents and publications, cited above and below, and of corresponding application German P 42 35 263.0, filed Oct. 20, 1993, are hereby incorporated by reference.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A cooking range (1) of modular construction comprising at least one cooking surface in the form of a glass/glass ceramic cover with cooking zones (2–5) wherein control/signal elements (20, 21) combined in at least one polygonal or semicircular functional area (10; 11–13) along a side of the cooking range are integrated, wherein the functional area is made of glass/glass ceramic and arranged as a unit spatially separated from the cooking surface and independently replaceable; the functional area including openings (14–19) for receiving switches and signal lamps, the openings (14–19) being flush-sealed to the surface of the functional area (6) interfaced with the cooling surface by a permanently elastic silicon adhesive (22) configured as a membrane, a short-stroke switch (21) being arranged as a functional element underneath the silicon adhesive membrane (22) (FIG. 10), the cooking range further including a frame enclosing the cooking range without the functional areas with corresponding frame parts (24*a*) being fixed to the functional area (6), the functional area being attachable to the cooking range as a complete extension module (FIG. 12).

2. The cooking range according to claim 1, wherein the respective functional elements (20, 21) are integrated in the functional area (6) before installation of said functional area in the cooking range (1) and wherein the functional area, as well as the cooking range, comprise plug connections (25).

3. The cooking range according to claim 2, wherein mechanical fastening means are provided on the bottom side of the cover of the functional area and on the cooking range (1) as well as the frame (24) (FIGS. 13–15).

4. The cooking range according to claim 3, wherein air gaps (x) are disposed between the functional area (6) and the cooking range (1) and between the functional area (6) and the frame (24) wherein the air gaps are filled with a silicon adhesive (FIG. 14).

5. The cooking range according to claim 3, wherein the air gaps between the functional area (6) and the cooking range (1) as well as the frame (24) are sealed by an elastic gasket cord or elastic profile ring.

6. The cooking range according to claim 3, wherein the edge of the cover of the functional area (6) has a stretched silicon sealing-ring.

7. A cooking range having a first glass/glass ceramic panel including at least one cooking zone and including at least one second glass/glass ceramic panel with openings bored therethrough for receiving and retaining therein control switches, means for mounting the second panel in the cooking range independently of and proximate to the first panel whereby the second panel provides a replaceable module, which is replaceable without substantially disturbing the first panel.

8. The cooking range of claim 7, wherein the first and second panels are coplanar.

9. The cooking range of claim 8, wherein the first and second panels have edges which face one another in spaced relation with respect to one another and wherein an adhesive material is disposed between the edges of the first and second panels.

10. The cooking range of claim 9, wherein the first and second panels combine to define a rectangular area and wherein the second panel is triangular.

11. The cooking range of claim 10, wherein the first and second panels are each mounted within peripheral flanges which are inverted L-shaped in cross-section and rest on inverted L-shaped brackets fixed to a vertical leg of the inverted L-shaped flange members.

12. The cooking range of claim 11 further including at least one bendable tab fixed to the bottom of the second panel for fitting under a horizontal leg of the inverted L-shaped bracket.

13. The cooking range of claim 12, wherein a flange is adhered to the bottom of the first panel and extends horizontally with respect thereto across the gap between the panels and wherein the second panel includes a horizontally extending tab adhered to the bottom thereof which fits beneath the flange to retain the second panel in juxtaposition with the first panel.

14. The cooking range of claim 11, wherein the second panel includes threaded studs projecting from the bottom thereof which are received through the peripheral flanges and secured to the peripheral flanges with threaded fasteners.

15. The cooking range of claim 7 further including visual indicator means positioned in at least one of the openings bored through the second panel.

* * * * *